US011258178B2

(12) United States Patent
Julien et al.

(10) Patent No.: US 11,258,178 B2
(45) Date of Patent: Feb. 22, 2022

(54) ANTENNA AND METHOD OF ASSEMBLY OF SUCH ANTENNA

(71) Applicant: Nokia Shanghai Bell Co., Ltd., Shanghai (CN)

(72) Inventors: Thomas Julien, Lannion (FR); Jean-Pierre Harel, Lannion (FR); Zied Charaabi, Lannion (FR); Patrick Lecam, Lannion (FR); Jerome Plet, Lannion (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 133 days.

(21) Appl. No.: 16/652,446

(22) PCT Filed: Oct. 2, 2018

(86) PCT No.: PCT/IB2018/057626
§ 371 (c)(1),
(2) Date: Mar. 31, 2020

(87) PCT Pub. No.: WO2019/069216
PCT Pub. Date: Apr. 11, 2019

(65) Prior Publication Data

US 2020/0235479 A1 Jul. 23, 2020

(30) Foreign Application Priority Data

Oct. 2, 2017 (EP) ..... 17306315

(51) Int. Cl.
*H01Q 9/04* (2006.01)
*H01Q 21/08* (2006.01)
(Continued)

(52) U.S. Cl.
CPC ..... *H01Q 9/0471* (2013.01); *H01Q 5/40* (2015.01); *H01Q 21/0075* (2013.01); *H01Q 21/08* (2013.01); *H01Q 21/28* (2013.01)

(58) Field of Classification Search
CPC ..... H01Q 1/1242; H01Q 1/246; H01Q 1/42; H01Q 5/10; H01Q 5/40; H01Q 9/0471; H01Q 21/0075; H01Q 21/28; H01Q 21/08
See application file for complete search history.

(56) References Cited

U.S. PATENT DOCUMENTS

2007/0236317 A1 10/2007 Cheng et al.
2012/0299799 A1 11/2012 Chiu et al.

FOREIGN PATENT DOCUMENTS

CN 102394342 A 3/2012
CN 203134968 U 8/2013
TW 575979 B 2/2004

OTHER PUBLICATIONS

International Search Report for PCT/IB2018/057626 dated Jan. 30, 2019.

*Primary Examiner* — Robert Karacsony
(74) *Attorney, Agent, or Firm* — Fay Sharpe LLP

(57) ABSTRACT

An antenna comprising: a longitudinal support member for supporting components of the antenna and a method of assembling such an antenna is disclosed. The components supported by the longitudinal member comprise: at least one signal feed probe configured to capacitively supply a signal to a corresponding at least one radiating patch; the at least one radiating patch mounted to at least partially wraparound the longitudinal support member; and signal supply circuitry for supplying a signal to the at least one signal feed. The signal supply circuitry is mounted on an outer surface of the inner longitudinal support member; and the longitudinal
(Continued)

support member is formed of a conductive material and forms a ground plane for the antenna.

11 Claims, 4 Drawing Sheets

(51) Int. Cl.

| | |
|---|---|
| ***H01Q 21/28*** | (2006.01) |
| ***H01Q 21/00*** | (2006.01) |
| ***H01Q 5/40*** | (2015.01) |

ANTENNA AND METHOD OF ASSEMBLY OF SUCH ANTENNA

FIELD OF THE INVENTION

The field of the invention relates to antenna and in particular embodiments to multi-directional or quasi-omni-directional antenna that is antenna that seek to radiate uniformly in all directions in one plane, and their method of assembly.

BACKGROUND

The structure of an omnidirectional antenna is conventionally provided by the outer structure or radome which provides the structural support. Omnidirectional antennas seek to emit radiation uniformly in all directions in one plane and this restricts the materials from which the outer structure can be made, and in particular, means that they cannot be reinforced with metallic parts without impacting the radiation patterns. The radiating elements inside can be made from printed circuit board (PCB), metallic parts, etc., but these do not generally play a role in the structure of the antenna. The architecture of many omnidirectional antennas is one of a long length and a relatively small profile. This makes it difficult to build such antenna that are able to withstand harsh conditions such as high winds, gust effects, vibrations, and temperature changes. It would be desirable to provide a robust multi directional antenna.

SUMMARY

A first aspect of the present invention provides an antenna comprising a longitudinal support member for supporting components of said antenna, said components comprising:

at least one signal feed probe configured to capacitively supply a signal to a corresponding at least one radiating patch, said at least one radiating patch mounted to at least partially wraparound said longitudinal support member, and signal supply circuitry for supplying a signal to said at least one signal feed probe, wherein said signal supply circuitry is mounted on an outer surface of said longitudinal support member, and said longitudinal support member is formed of a conductive material and forms a ground plane for said antenna, said antenna further comprises at least one retaining member for mounting said at least one of said signal supply circuitry and said signal feed probe onto said longitudinal support member, at least a portion of an outer perimeter of said retaining member comprises at least a portion of a circumference of a circle, said at least one radiating patch being mounted around at least a portion of said retaining member.

The inventors of the present invention recognised that owing to their long length and relatively small profile it is difficult to manufacture antenna that seek to radiate in multiple directions within a plane such as quasi-omnidirectional antenna, to withstand harsh conditions, such as wind, gust effects, vibrations and temperature changes, particularly as any external support mechanism needs to be substantially transparent to the radiation emitted, which precludes the use of metallic structures. They devised a solution to this with the use of a longitudinal support member that is located within the radiating elements and that provides both support and a ground plane for some components of the antenna without obstructing the radiation field. Furthermore, by providing radiating patches in a form that at least partially wrap around the support structure, the radiating pattern generated by the patch(es) is not obstructed by the support element. Additionally mounting the signal supply circuitry on an outer surface of the support member allows it to be conveniently coupled to the signal feed probe.

The use of a rigid rod type structure, perhaps made of metal, allows a low weight structurally robust core to the antenna on which the other components can be mounted and held securely. The conductive nature of the internal longitudinal support member provides a ground plane for coupling with the signal feed probe and supply circuitry as well as for the radiating patch. The longitudinal support member is within the radiating elements of the antenna and may in some embodiments form the central structure of the antenna with the other components being arranged around it.

The signal supply circuitry is mounted on an outer surface of the longitudinal support member and extends along at least some of its length providing a signal to one or more signal feed probes that are arranged to be capacitively coupled to one or more corresponding radiating patches which may be found along the length of the support member. In this way there is an inner, central support that is both rigid and may be lightweight and which has the additional advantage of providing a ground plane for the other components.

The signal supply circuitry and signal feed probe are attached to the longitudinal support member using one or more retaining members. These may be made of an insulating material such as plastic and may have the form of a clip allowing for ease of assembly and manufacture.

As the radiating patch(es) are wrapped around the internal support member, in order to hold them effectively and at a generally known and constant distance from the internal longitudinal support member some sort of spacing means may be advantageous. In this regard, providing a retaining member that has at least a portion of an outer perimeter in the form of a circumference of a circle provides both for effective support and effective and predictable spacing of the flexible radiating patch from the internal support member leading to better and more predictable performance.

Although in some embodiments there may only be one radiating patch, embodiments are particularly applicable to antenna with multiple radiating patches and corresponding signal feed probes. Where there are multiple patches these are arranged in a longitudinal direction along the length of the antenna and they thereby increase its length and its sensitivities to external forces. Multiple patches are used to increase the gain of the antenna but result in long antenna with corresponding robustness issues. Embodiments address these issues by providing a central robust support member which also serves as a ground plane.

In some embodiments, said at least one signal feed probe is mounted on said longitudinal support member at a predetermined distance from said longitudinal support member, and said signal supply circuitry extends to contact said signal feed probe.

The signal feed probe may be mounted on the longitudinal support member but in some embodiments it is mounted at a predetermine distance from the longitudinal support member. In this regard, the signal feed probe provides capacitive coupling of the signal to the radiating patches and as such is preferably mounted at a distance from the support member which acts as a ground plane and also at a distance from the radiating patches to which it is capacitively coupled. Where there are multiple signal feed probes and corresponding multiple antenna patches then these are arranged along the length of the longitudinal member and held at a substantially same distance from this longitudinal support member.

Preferably, each of the radiating elements are held at the same or substantially the same distance from their corresponding signal feed probe. In this regard, the distance is selected to provide effective coupling. For the sake of this application the radiating elements are deemed to be held at the same distance if a variation in the distances is less than 10%.

The signal supply circuitry that supplies the signal to the signal feed probe extends to contact the signal feed probe that is mounted at a distance from the longitudinal support member. Once they are both mounted in position, soldering a connection between the two is a simple matter and allows this step to be performed without the need to separately hold the different feed and supply circuitry.

It should be noted that the signal feed probe and signal supply circuitry may have a number of forms. In this regard, the signal supply circuitry may comprise a printed circuit board with signal supply tracks mounted on it such that the signal is sent to the various signal feed probes using power dividing circuitry. Alternatively, the signal supply circuitry may be formed of wires or cables. The signal feed probe may also comprise a printed circuit board and where this is the case the signal supply circuitry printed circuit board will extend to meet the signal feed probe printed circuit board and a solder connection will be formed between the two such that the tracks are electrically connected.

In some embodiments, said inner longitudinal support member comprises at least two longitudinally extending surfaces angled with respect to each other, said at least one signal feed probe being mounted at a predetermined distance from an external one of said surfaces and said signal supply circuitry being mounted on an external other one of said surfaces.

Although the inner longitudinal support member may simply comprise a rod such as a metallic rod, in some embodiments it is formed of a longitudinal element that has at least two longitudinal surfaces that are angled with respect to each other. The signal feed probe is mounted a predetermined distance and is in general parallel to one of the surfaces, while the signal supply circuitry is mounted on the other one.

Although, the two surfaces may be arranged at one of a number of different angles with respect to each other, in some embodiments said inner longitudinal support member comprises a U-shaped rod, said at least one signal feed probe and said signal supply circuitry being mounted with respect to outer surfaces of said U-shaped rod that are substantially at right angles to each other.

Having a U-shaped rod provides a lightweight robust and generally rigid form and mounting the signal feed probe and signal supply circuitry on or at a distance from different outer surfaces of such a U-shaped rod makes the antenna easy to assemble and the soldering to form the connections between the two straightforward.

In some embodiments, said retaining member comprises a resilient portion, said resilient portion being configured to bias said signal supply circuitry against said longitudinal support member.

Preferably, the retaining member will have a resilient portion that can be configured to bias the signal supply circuitry against the longitudinal support member. Biasing the signal supply circuitry against the longitudinal support member provides for both effective and predictable capacitive coupling between the ground plane provided by the support member and the signal supply circuitry. In this regard, where the signal supply circuitry is formed as a printed circuit board then the printed circuit board will have its own ground plane that is copper but there will be a protective varnished layer between it and the ground plane provided by the support member. Reducing any gap between the printed circuit board and the support member will improve the contact and the conductivity between the copper ground plane of the printed circuit board and the ground plane provided by the longitudinal support member improving the functionality of the ground plane and the performance of the device.

As noted previously it may be advantageous if the retaining member is an insulated material such as plastic. Furthermore such a material may itself have resilient properties and/or be formed of a shape to provide such resilient properties allowing an effective biasing of the signal supply circuitry.

One thing to note about the design of embodiments of the antenna is that the design is in some respects modular and as such is scalable. Thus, the antenna may simply comprise one signal feed probe and a corresponding radiating patch. Alternatively, where the power and performance requirements are high then these may be duplicated along the longitudinal length of the antenna and a longer antenna with a longer support member and multiple antenna patches and signal feeds may be provided.

Where the antenna patches are held in position by retaining members then the number of retaining members may in some embodiments be increased in a corresponding way to the number of radiating patches and signal feed probes. Thus, in some embodiments the number of retaining members may be equal to the number of radiating patches and each radiating patch may be held by a corresponding retaining member allowing for a secure and robust arrangement and one where each radiating patch is held at a predictable distance from the internal support member. Although, this may provide some advantages it should be understood that in other embodiments there may be fewer retaining members or in some embodiments additional retaining members to the number of radiating patches. In this regard, it should be understood that increasing the number of retaining members increases the strength and robustness of the antenna but also increases the cost.

Although, the radiating patches may be formed in a number of ways, in some embodiments said at least one radiating patch is formed on a flexible printed circuit board.

A flexible printed circuit board is a convenient and effective way of mounting a radiating patch and providing a radiating patch that can wrap around an internal support member. In some embodiments the flexible circuit board is itself mounted on a flexible material. The flexible material may form a hollow pipe which provides a skeleton on which the flexible circuit board of the one or more radiating patches is mounted.

Although, the antenna may comprise a single band antenna in some embodiments, said antenna comprises a dual band antenna, a first portion configured to operate in a first frequency band and a second portion configured to operate in a second frequency band, said first and second portion being arranged subsequent to each other in a longitudinal direction; said antenna comprising an input port at a longitudinal end adjacent to said first portion for receiving two signal feed probe cables for respectively supplying signals in said first frequency band and signals in said second frequency band; said antenna comprising a signal feed probe supply cable for supplying a signal from said input port to said second portion, said signal feed probe supply cable being configured to run parallel to and be at least partially shielded by said longitudinal support member.

Another issue to be addressed within the context of omnidirectional antennas is related to the addition of frequency bands. Generally, an omnidirectional antenna works on a single frequency band, with one connector at the bottom. Having a dual band omnidirectional antenna with 2 connectors such that the antenna that can work simultaneously in two frequency bands requires each frequency band signal to be fed to the antenna with preferably no or little impact on the other one. Thus, although dual band and multi band omnidirectional antenna exist, they are generally configured with a single connector for a single signal feed, and although the antenna is configured to operate effectively in different frequency bands so that different frequency band signals may be supplied to the antenna, the antenna cannot operate on multiple frequency bands simultaneously.

The use of an internal support member allows for a longer antenna that is robust and easy to manufacture and as such, dual or even multiple band antennas may be manufactured with the components for radiating at different frequency bands being arranged subsequent to each other in a longitudinal direction. The cable providing the different, independent signal feeds may enter at one end at an input port and the cable feeding the subsequent antenna portions that are remote from the signal port may run along the support member and where it is formed with angled surfaces may run in a groove between the angled surfaces for example within the U of a U-shaped longitudinal member thereby being held in place and effectively shielded from the radiating patches.

A second aspect provides a method of assembling an antenna comprising:

- mounting at least one signal feed probe configured to capacitively supply a signal to a corresponding at least one radiating patch on at least one retaining member,
- mounting said at least one retaining member on a longitudinal support member, such that said at least one signal feed probe is held at a predetermined distance from said longitudinal support member,
- mounting signal supply circuitry for supplying a signal to said at least one signal feed probe on an outer surface of said longitudinal support member,
- wrapping at least one radiating patch at least partially around said longitudinal support member,
- wherein said longitudinal support member is formed of a conductive material and provides a ground plane for said antenna,
- wherein at least a portion of an outer perimeter of said retaining member comprises at least a portion of a circumference of a circle,
- said method comprises mounting said at least one radiating patch on two circumferentially remote points on an outer surface of said at least one retaining member such that said radiating patch wraps around said at least one retaining member.

In addition to providing a robust lightweight antenna embodiments also provide one with a simple mechanical design that is easy to assemble. By providing an internal support on which the other components are mounted it has been found that the assembly can be straightforward. Furthermore, as the signal supply circuitry is on an outer surface of the support member, providing a connection between the signal supply circuitry and the signal feed probe is convenient and straightforward to do.

In some embodiments, said retaining member comprises a resilient portion and said step of mounting said signal supply circuitry on said longitudinal support member comprises biasing said signal supply circuitry against an outer surface of said longitudinal support member using said resilient portion.

Providing retaining means having a resilient portion allows not only the supply circuitry signal feed probe to be easily and effectively mounted on the longitudinal support member but also allows the signal supply circuitry to be biased against it providing effective grounding of this circuitry and effective capacitive coupling.

Additionally, by mounting the signal supply circuitry and the signal feed probe on the internal support member and in some embodiments at an angle to each other electrical connection between them can be provided in an effective and straightforward manner by simply providing a soldering joint between the two without the need to support the different components separately during the procedure.

In some embodiments, the method further comprises mounting said at least one radiating patch on two circumferentially remote points on an outer surface of said at least one retaining member such that said radiating patch wraps around said at least one retaining member.

As well as being used to retain the signal supply circuitry and signal feed probe the retaining member can also be used as a mounting point for the radiating patch which where the retaining member has a circular outer perimeter allows the radiating patch to be held in a circular form at a predetermined distance from the internal support member. The distance of the radiating patch from the signal feed probe that capacitively couples the signal to the radiating patch is important and thus, having a stable and predictable mounting means for the radiating patch, which due to its flexible nature is deformable is advantageous.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present invention will now be described further, with reference to the accompanying drawings, in which.

DESCRIPTION OF THE EMBODIMENTS

Before discussing the embodiments in any more detail, first an overview will be provided.

Embodiments provide a lightweight multi directional antenna. Generally much of the structural integrity of a multi directional antenna is provided by the radome. Owing to the internal longitudinal support member of antennas according to embodiments a thinner, less structurally robust radome can be used leading to a robust antenna with a lighter weight structure.

The radiating patches used for omnidirectional radiating patterns are put in place to surround the skeleton of the antenna. The radiating patches comprise flexible PCBs rolled around the skeleton. This step may be performed towards the end of the antenna assembly process. Embodiments provide a structure with an essentially fishbone architecture. An internal longitudinal support member provides much of the internal structure of the antenna and provides support for the components mounted thereon. This allows the radome to be formed of a lightweight material that is transparent to the signals emitted by the antenna.

Such a structural design can be used for both single band and dual band omnidirectional antenna, the latter having two independent antennas placed one above the other, each one with a dedicated connector or signal feed.

Where the antenna is a dual signal antenna, then the inner longitudinal support member with angled sides is able to both guide and shield the signal input cable to the portion of the antenna remote from the signal input operable to transmit the second signal. The architecture also simplifies the antenna's overall assembly, and reduces the number of parts.

In effect the antenna itself creates the structure of the overall design.

Figure 1:
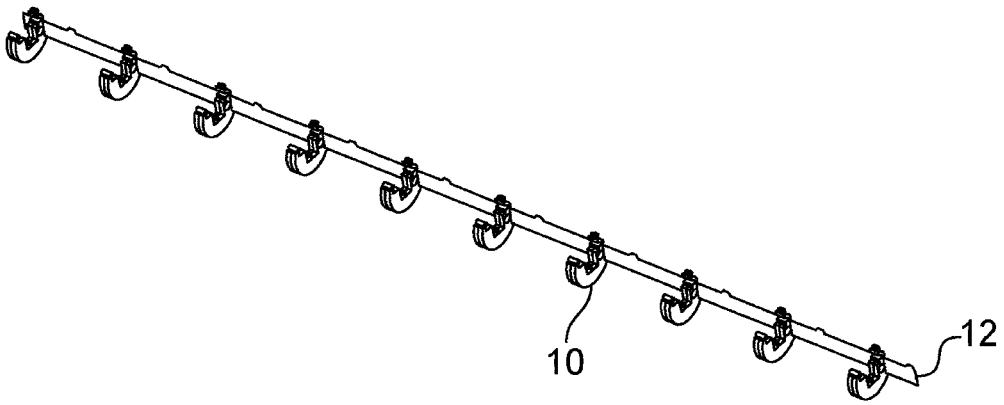
FIG. 1 illustrates the signal feed probes mounted on clips.
Figure 2:
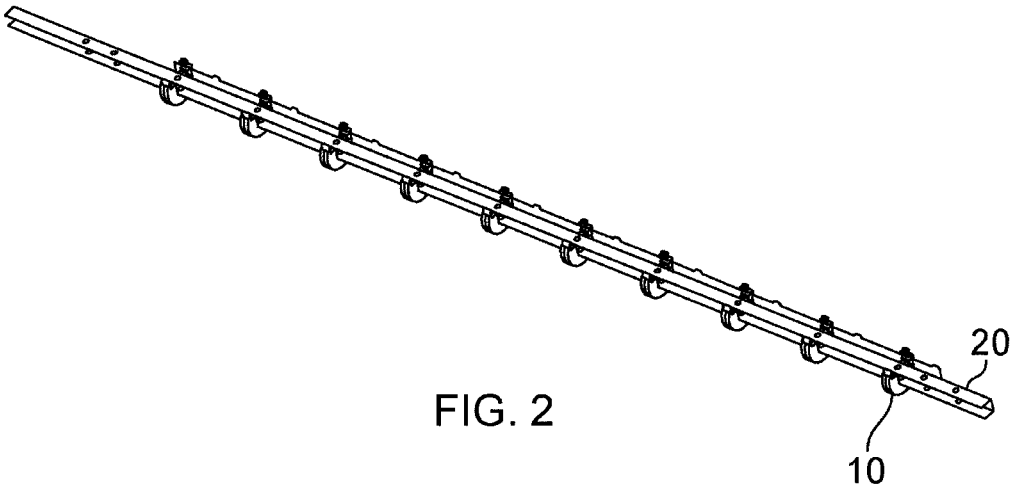
FIG. 2 shows the longitudinal support member mounted within the clips on which the signal feed probes are mounted.

In embodiments the radiating elements are formed of patches that are wrapped around the central structure. The central structure comprises signal feed probe(s) for providing the signal to the radiating patch(es). These are formed on a single PCB which runs along the length of the antenna. Clips are provided periodically along the length of the signal feed probe PCB and a U shaped metallic rod is held in position in U-shaped recesses within the clips (FIGS. 1 and 2). This metallic rod provides much of the structural support for the antenna and also forms a ground plane for many of the elements.

A second PCB used as a signal supply circuitry to supply a signal to the signal feed probe(s) is mounted on an outer surface of the U-shaped rod and is locked in place by resilient closure members which attach to the plastic clips. The overall design with the rod as the backbone provides a fishbone type structure that provides strength to the design with a relative low weight (see FIG. 3).

Figure 4:
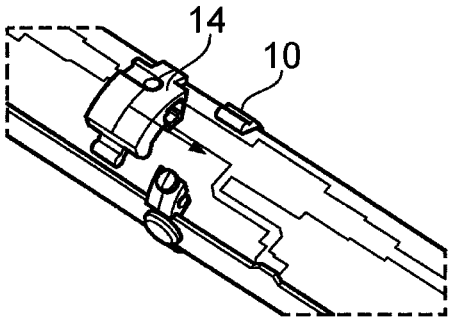
FIG. 4 shows how the resilient means are attached to the clips.

The closure member portion of the clip is slid inside the lower plastic part of the clip, and exerts pressure between the feeding PCB and the U shaped rod (see FIG. 4). As a result, grounding of the PCB is provided by the metallic rod and the space available inside this U-shaped rod can be used for the input signal cable (see FIG. 5, section view) where required.

The lower plastic part of the clip supports the signal feed probe PCB and the two PCBs extend at right angles to each other. The mounting of the two PCBs in this way allows electrical connection of the signal supply PCB and signal feed probe PCB using soldering without the need to hold these PCBs in place (see FIG. 10).

Figure 7:
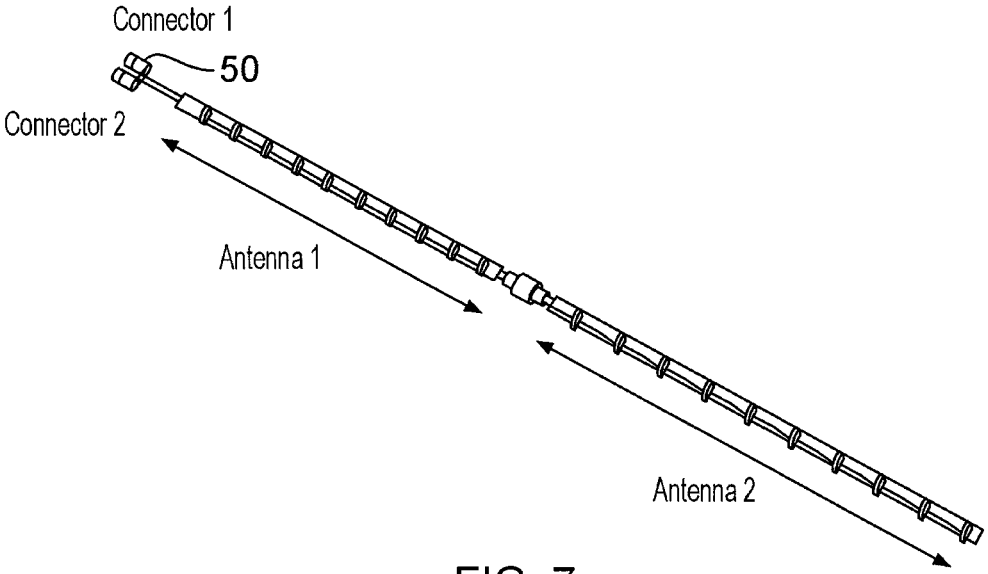
FIG. 7 shows a dual band omnidirectional antenna according to an embodiment.

In one embodiment two omnidirectional antennas having different frequency bands are superimposed one on top of the other. The overall antenna has two connectors at the bottom to feed the two antennas operating in different frequency bands (see FIG. 7).

The overall design provides a particularly effective antenna for such an arrangement, the feeding cable of antenna 2 being guided and shielded inside antenna 1 using the U shaped metallic profile.

Figure 8:
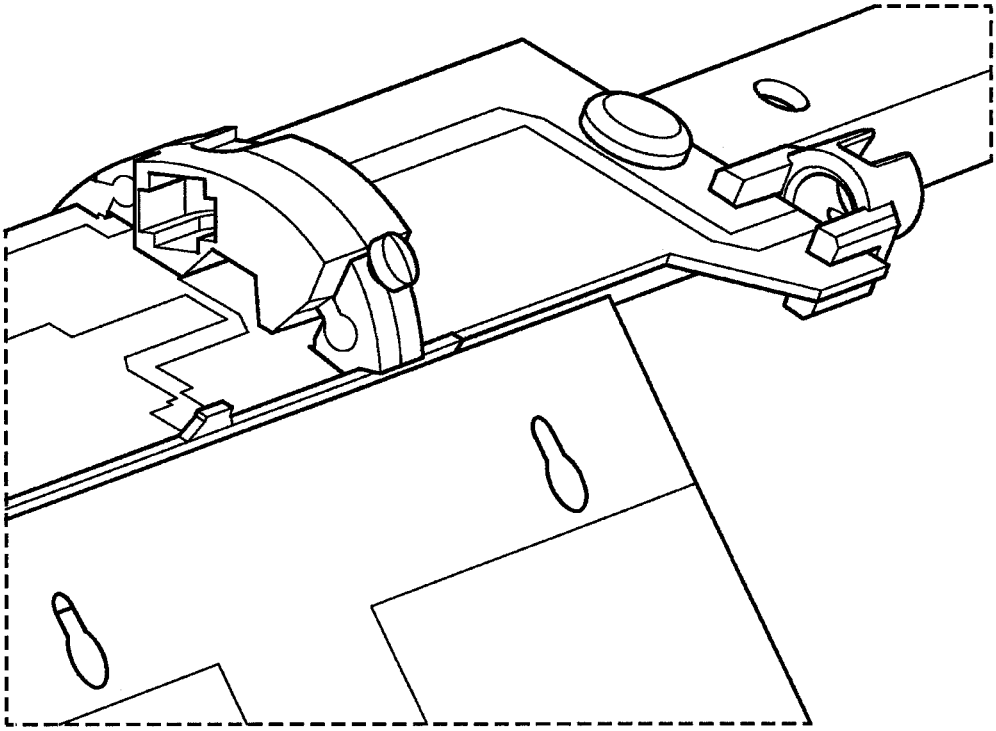
FIG. 8 shows a signal input coupled to signal feed circuitry according to an embodiment.
Figure 9:
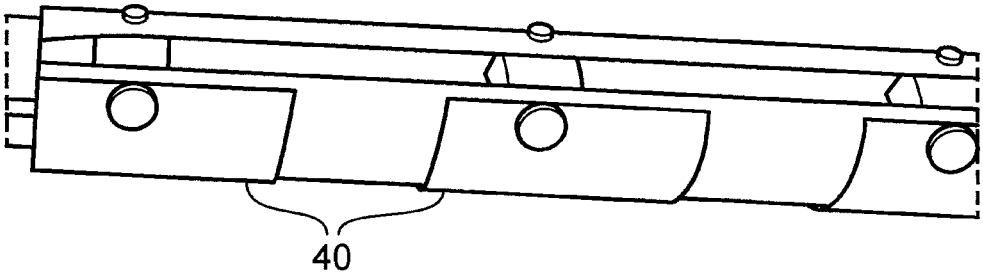
FIG. 9 shows the wrapped antenna patches of an embodiment.

In embodiments a flexible PCB provides the radiating patches. The patches are printed on a flexible PCB, which is then rolled around the fishbone structure. The patches are attached on one side with a dedicated cut-out on the PCB and a matching shape on the supporting plastic clip, they are then rolled around the antenna, and locked in place with a plastic rivet (see FIGS. 8 to 10).

Figure 3:
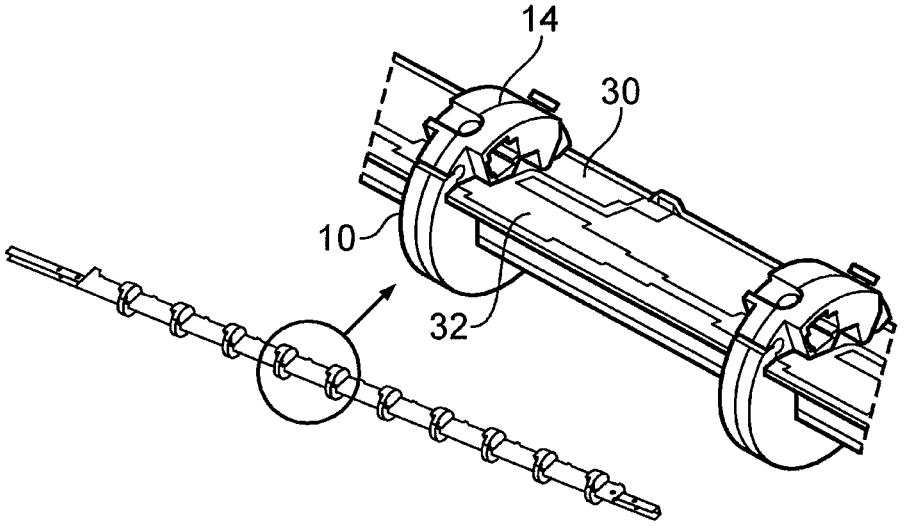
FIG. 3 shows signal supply circuitry mounted pressed against the longitudinal member by resilient means on the clips.
Figure 5:
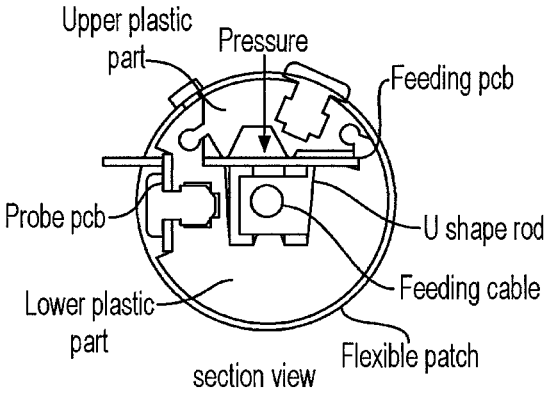
FIG. 5 shows a section view of the antenna.
Figure 6:
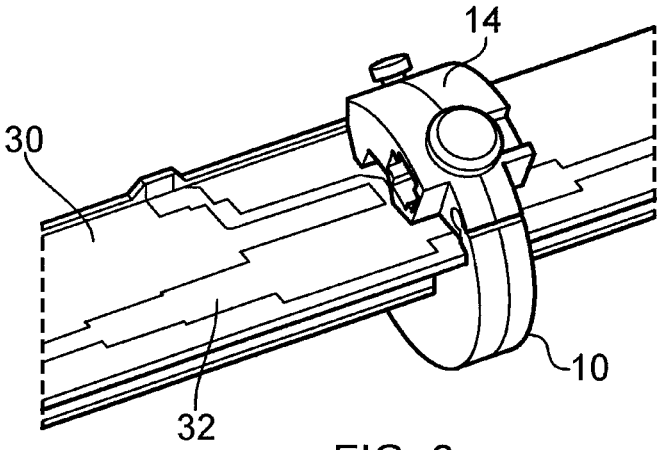
FIG. 6 shows a portion of the assembled antenna.

Assembly of the antenna follows the following steps. Plastic clips 10 with a curved outer surface and a U-shaped central recess are mounted along a PCB 12 comprising signal feed probes 32 in the form of tracks on the PCB (FIG. 1). A U-shaped metallic rod 10 is slid into the U-shaped central recess of the clip (FIG. 2) and a PCB with signal supply circuitry is mounted on the U-shaped rod at right angles to the signal feed probe PCB 30 (FIG. 3). The signal supply circuitry PCB 30 is held biased against the metallic U-shaped rod by resilient portions 14 that slide into the plastic clips 10 (FIG. 4). A clip with a substantially circular outer circumference is in this way provided for holding the different components of the antenna at different places along the length of the antenna (FIGS. 5 and 6).

Figure 10:
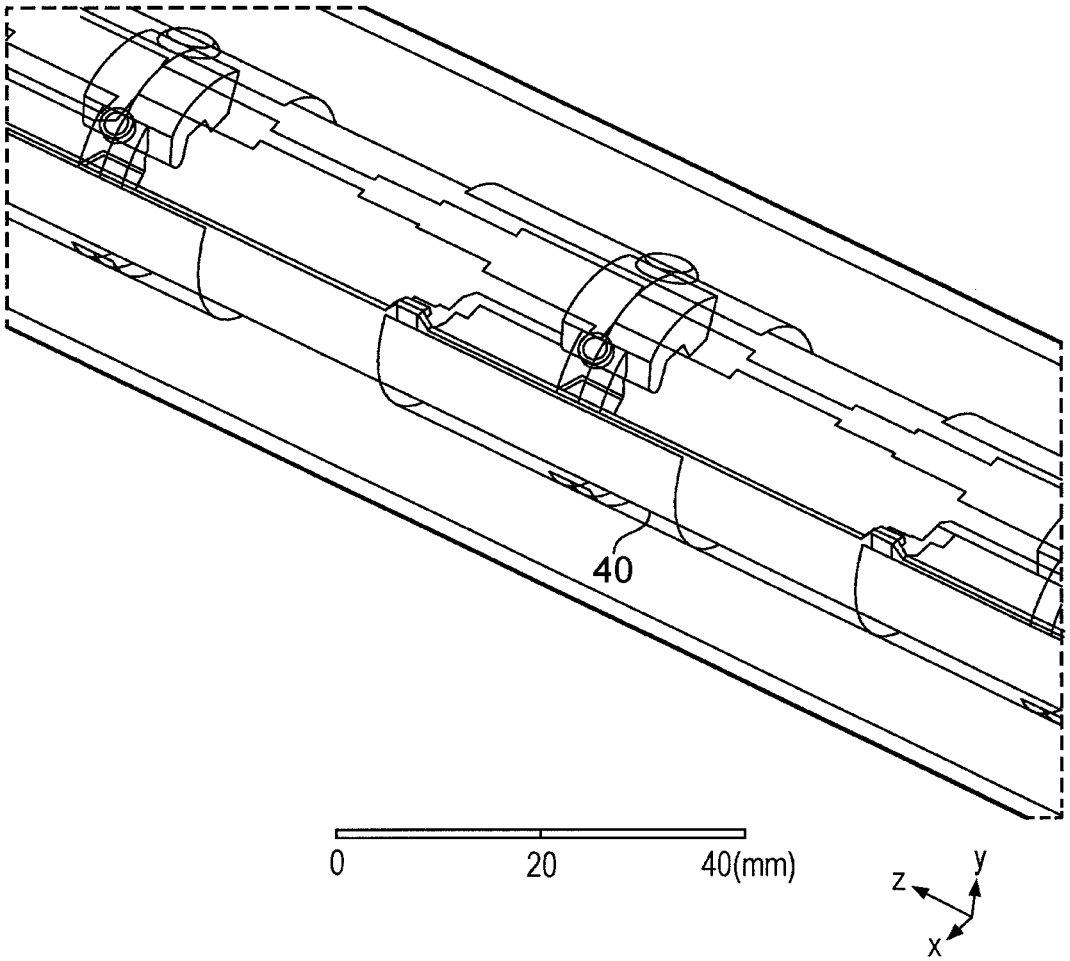
FIG. 10 shows an outer view of the antenna of an embodiment within a radome.

An electrical connection between the signal supply circuitry on one PCB and the signal feed probes on the other can then be made in a straightforward manner by soldering (FIG. 10).

A flexible material comprising flexible radiating patches 40 is then wrapped around the inner components of the antenna and held in place by rivets which pass through holes in the flexible material and slot into recesses in the circular clips. The circular outer circumference of the clips provides support and gives a circular form to the flexible material of the radiating elements 40 and holds them at a fixed distance from the signal feed probes with which they are capacitively coupled (see FIGS. 9 and 10).

A signal feed input 5*o* is provided towards one end of the antenna. It is configured to receive one or more signal input cables and is electrically coupled to the signal supply circuitry (see FIG. 8). Where there are two antennas in a line (FIG. 7), then the signal input for the second antenna is coupled to a cable running within the U-shaped metallic rod, which is then electrically coupled to the signal supply circuitry of antenna 2.

In summary embodiments provide a low weight, robust quasi-omnidirectional antenna, which in some embodiments provides 2 antennas operational at the same time. Furthermore, the antenna is cost efficient being made of a limited number of simple parts.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. An antenna comprising a longitudinal support member for supporting components of said antenna, said components comprising:

at least one signal feed probe configured to capacitively supply a signal to a corresponding at least one radiating patch, said at least one radiating patch mounted to at least partially wraparound said longitudinal support member, and signal supply circuitry for supplying a signal to said at least one signal feed probe, wherein said signal supply circuitry is mounted on an outer surface of said longitudinal support member, and wherein said longitudinal support member is formed of a conductive material and forms a ground plane for said antenna, said antenna further comprises at least one retaining member for mounting said at least one of said signal supply circuitry and said signal feed probe onto said longitudinal support member, at least a portion of an outer perimeter of said retaining member comprises at least a portion of a circumference of a circle, said at least one radiating patch being mounted around at least a portion of said retaining member.

2. An antenna according to claim 1, wherein said at least one signal feed probe is mounted on said longitudinal support member at a predetermined distance from said longitudinal support member, and said signal supply circuitry extends to contact said signal feed probe.

3. An antenna according to claim 1, wherein said longitudinal support member comprises at least two longitudinally extending surfaces angled with respect to each other, said at least one signal feed probe being mounted at a predetermined distance from an external one of said surfaces and said signal supply circuitry being mounted on an external other one of said surfaces.

4. An antenna according to claim 3, wherein said longitudinal support member comprises a U-shaped rod, said at least one signal feed probe and said signal supply circuitry being mounted with respect to outer surfaces of said U-shaped rod that are substantially at right angles to each other.

5. An antenna according to claim 1, wherein said retaining member comprises a resilient portion, said resilient portion being configured to bias said signal supply circuitry against said longitudinal support member.

6. An antenna according to claim 1, comprising a plurality of signal feed probes and a corresponding plurality of radiating patches.

7. An antenna according to claim 6, comprising a plurality of retaining members, a number of said retaining members being equal to said number of radiating patches.

8. An antenna according to claim 1, said antenna comprising a dual band antenna, said antenna comprising a first portion configured to operate in a first frequency band and a second portion configured to operate in a second frequency band, said first and second portion being arranged subsequent to each other in a longitudinal direction, said antenna comprising an input port at a longitudinal end adjacent to said first portion for receiving two signal feed probe cables for respectively supplying signals in said first frequency band and signals in said second frequency band, said antenna comprising a signal feed probe supply cable for supplying a signal from said input port to said second portion, said signal feed probe supply cable being configured to run parallel to and be at least partially shielded by said longitudinal support member.

9. A method of assembling an antenna according to claim 1, said method comprising:

mounting at least one signal feed probe configured to capacitively supply a signal to a corresponding at least one radiating patch on at least one retaining member, mounting said at least one retaining member on a longitudinal support member, such that said at least one signal feed probe is held at a predetermined distance from said longitudinal support member, mounting signal supply circuitry for supplying a signal to said at least one signal feed probe on an outer surface of said longitudinal support member, wrapping at least one radiating patch at least partially around said longitudinal support member, wherein said longitudinal support member is formed of a conductive material and provides a ground plane for said antenna, wherein at least a portion of an outer perimeter of said retaining member comprises at least a portion of a circumference of a circle, said method comprises mounting said at least one radiating patch on two circumferentially remote points on an outer surface of said at least one retaining member such that said radiating patch wraps around said at least one retaining member.

10. A method according to claim 9, wherein said retaining member comprises a resilient portion and said step of mounting said signal supply circuitry on said longitudinal support member comprises biasing said signal supply circuitry against an outer surface of said longitudinal support member using said resilient portion.

11. A method according to claim 9, comprising connecting said signal supply circuitry to said at least one signal feed probe using solder.

* * * * *